US011452379B1

(12) United States Patent
Salazar

(10) Patent No.: US 11,452,379 B1
(45) Date of Patent: Sep. 27, 2022

(54) MEDITATION CHAIR

(71) Applicant: Nicholas M Salazar, Parker, CO (US)

(72) Inventor: Nicholas M Salazar, Parker, CO (US)

( * ) Notice: Subject to any disclaimer, the term of this patent is extended or adjusted under 35 U.S.C. 154(b) by 0 days.

(21) Appl. No.: 17/321,416

(22) Filed: May 15, 2021

Related U.S. Application Data

(63) Continuation-in-part of application No. 29/782,835, filed on May 10, 2021.

(51) Int. Cl.
*A47C 7/02* (2006.01)
*A47C 7/16* (2006.01)
*A47C 7/50* (2006.01)
*A47C 7/40* (2006.01)

(52) U.S. Cl.
CPC ..... *A47C 7/029* (2018.08); *A47C 7/16* (2013.01); *A47C 7/40* (2013.01); *A47C 7/503* (2013.01)

(58) Field of Classification Search
CPC .. A47C 7/028; A47C 7/16; A47C 7/40; A47C 7/503
USPC ..... 297/451.3, 452.21, 452.23, 452.24, 297/452.25, 452.63
See application file for complete search history.

(56) References Cited

U.S. PATENT DOCUMENTS 1,844,753 A * 2/1932 Gardiner ..... A47C 3/029 297/452.63 X
2,182,485 A * 12/1939 Murdock ..... A47C 7/16 297/452.63 X
2,316,628 A * 4/1943 Schaffner ..... A47C 7/028 5/247
2,320,786 A * 6/1943 Lucas ..... A47C 7/16 297/452.23
2,335,160 A * 11/1943 Schaffner ..... A47C 7/028 267/102
2,340,551 A * 2/1944 Morrison ..... A47C 7/028 267/80
2,358,437 A * 9/1944 Beachley ..... A47C 7/028 267/86
2,358,438 A * 9/1944 Beachley ..... A47C 7/028 29/91.1
2,798,538 A * 7/1957 Dreifke ..... A47C 7/405 297/452.63 X
D197,512 S * 2/1964 Poisson ..... 297/452.63 X
3,203,734 A * 8/1965 Seymer ..... A47C 7/405 297/452.63 X
D226,154 S * 1/1973 Introiini ..... D6/371
D249,414 S * 9/1978 Adkinson ..... D6/334
D279,338 S * 6/1985 Offredi ..... D6/373
4,673,216 A * 6/1987 Alter ..... A47C 15/004 297/452.26 X (Continued)

FOREIGN PATENT DOCUMENTS

DE 202014010014 U1 * 3/2015 ..... A47C 4/04
DE 202017105239 U1 * 10/2017 ..... A47C 7/028

*Primary Examiner* — Rodney B White
(74) *Attorney, Agent, or Firm* — Leyendecker & Lemire LLC

(57) ABSTRACT

A chair having a chair back with an enlarged and curved seating surface is described. The raised seating surface has a front to back dimension (depth) substantially similar to its left to right dimension (width) approximately 0.80 meters. The seating surface is further curved upwardly on the left and right sides relative to the front to back center of the seating surface. In one variation, the radius of curvature pertaining to the curve is approximately 1.0 meters.

18 Claims, 11 Drawing Sheets

(56) References Cited

U.S. PATENT DOCUMENTS

| | | | | | |
|---|---|---|---|---|---|
| 5,288,131 | A * | 2/1994 | Singley | A47C 5/14 | 297/452.21 |
| 5,374,109 | A * | 12/1994 | Wortman | A47C 9/027 | 297/452.22 |
| D391,408 | S * | 3/1998 | Lee | D6/381 | |
| 5,876,098 | A * | 3/1999 | Conaway | A47C 3/16 | 297/354.11 |
| 6,319,585 | B1 * | 11/2001 | Coronado | B32B 37/10 | 297/452.21 X |
| D516,330 | S * | 3/2006 | Ruiter | A47C 7/024 | D6/370 |
| 7,237,845 | B2 * | 7/2007 | Mulmed | A47C 7/24 | 297/452.63 X |
| 7,347,493 | B2 * | 3/2008 | Mulmed | A47B 87/007 | 297/452.63 X |
| D566,975 | S * | 4/2008 | Lee | D6/348 | |
| D573,806 | S * | 7/2008 | Pillet | D6/375 | |
| 7,628,455 | B2 * | 12/2009 | Brodeur | A47C 15/004 | 297/312 |
| 8,602,493 | B1 * | 12/2013 | Chen | A47C 7/029 | 297/452.23 X |
| D878,791 | S * | 3/2020 | Jacoby | D6/371 | |
| 10,575,646 | B2 * | 3/2020 | Roizner | A47C 3/16 | |
| D880,886 | S * | 4/2020 | Wanders | D6/369 | |
| 10,842,277 | B2 * | 11/2020 | Harden | A47C 5/005 | |
| 2007/0035169 | A1 * | 2/2007 | Sawyer | B60N 2/60 | 297/452.63 X |
| 2013/0320740 | A1 * | 12/2013 | Samiee | A47C 13/00 | 297/440.1 |

* cited by examiner

MEDITATION CHAIR

RELATED APPLICATION

This application claims priority to and incorporates fully by reference U.S. Design Patent application No. 29/782,835 filed on 10 May 2021 having the same title and inventor as the present application.

BACKGROUND

Often when mediating, a person sits cross legged. Generally, this requires the person to be seated on a floor as the seating surfaces on typical chairs are neither wide nor deep enough to accommodate a user seated in this position. Floors can be dirty and a people are often hesitant about sitting on a floor without an additional covering, such as a yoga mat. When sitting on a floor a person does not have support for his/her back. Chair seating surfaces (and floors for that matter) are usually flat and do not provide support for the knees and laterally extended portions of the legs when sitting cross legged.

DETAILED DESCRIPTION

Figure 1:
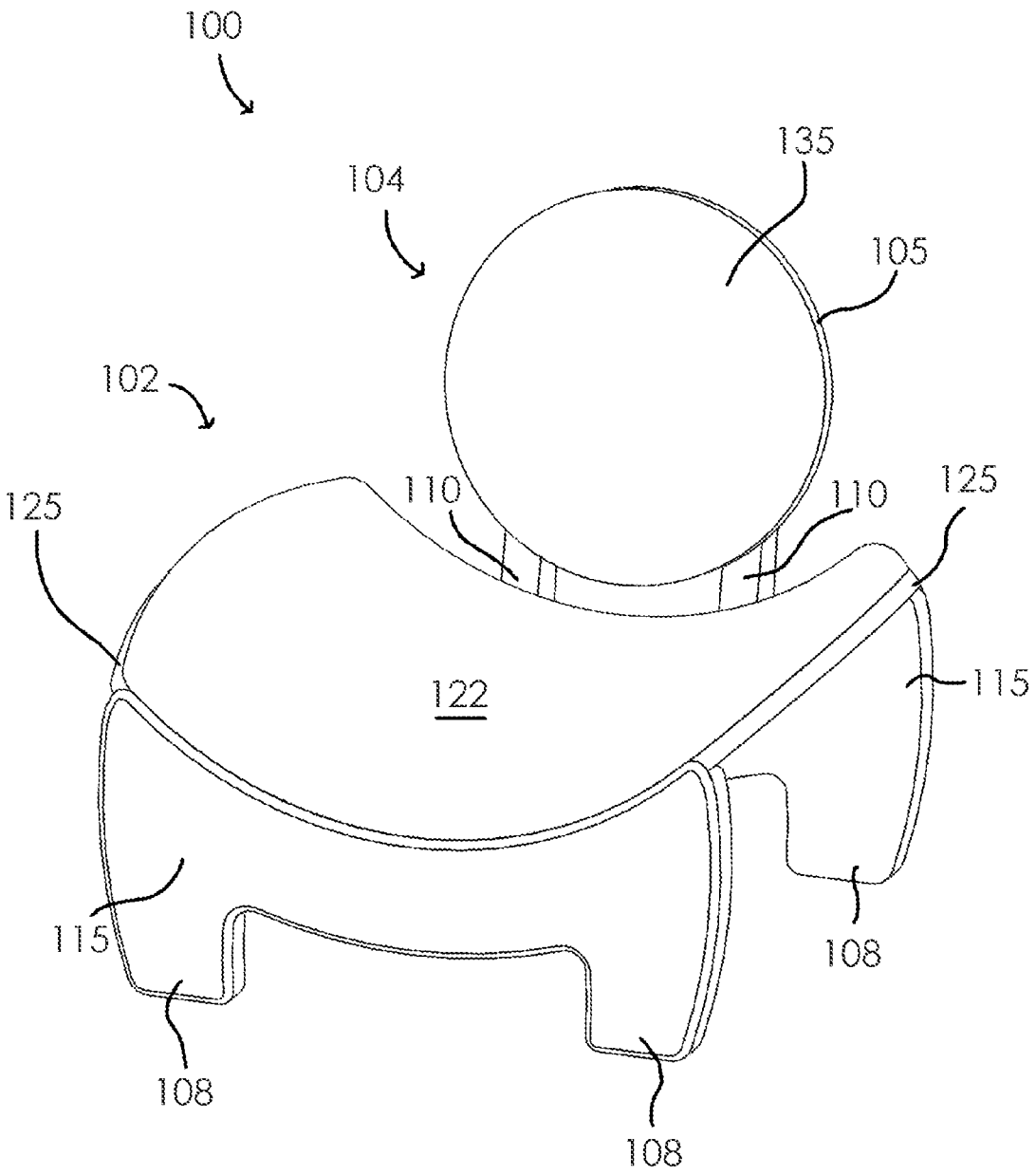
FIG. 1 is a front perspective view of a meditation chair according to one embodiment of the present invention.
Figure 2:
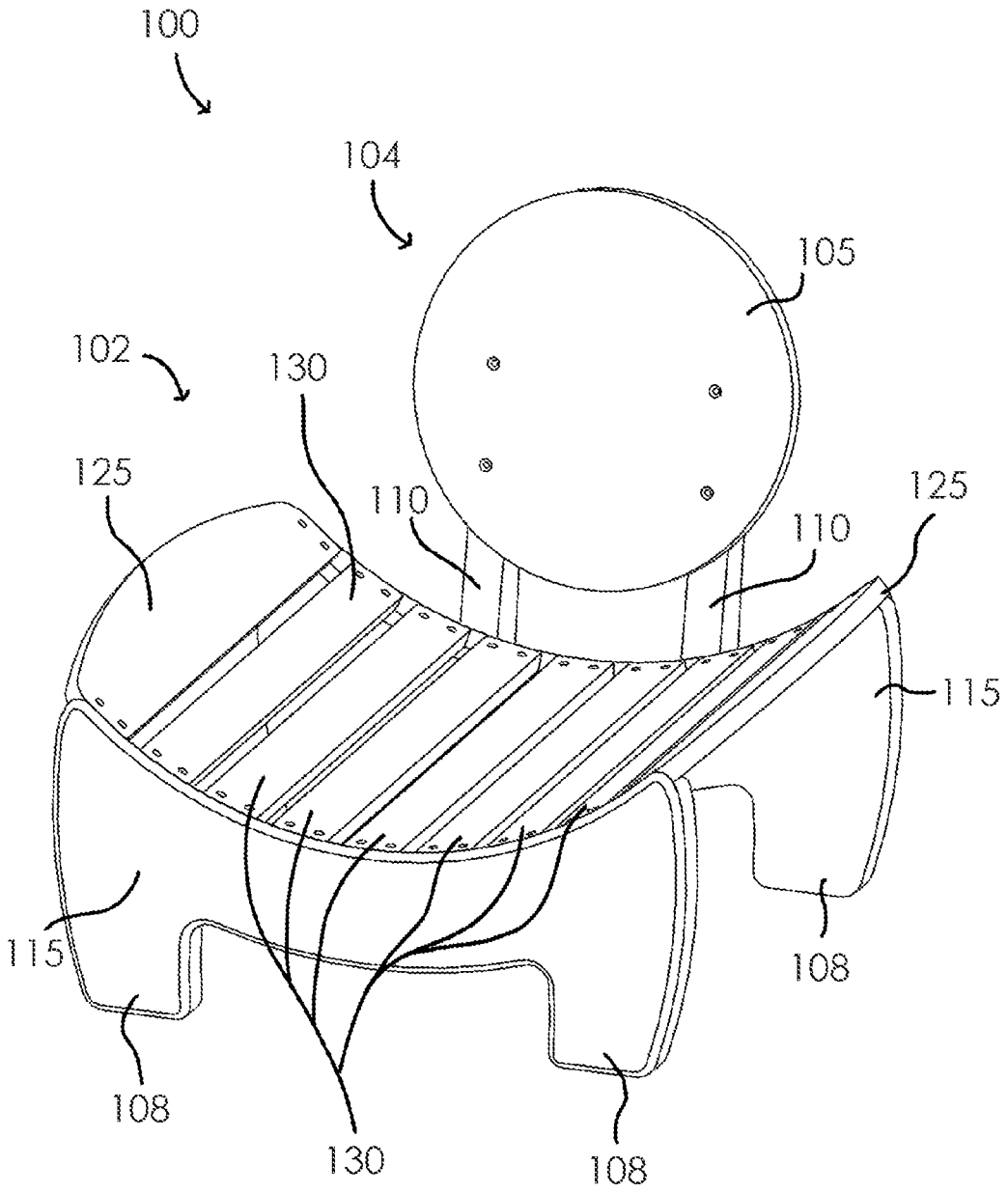
FIG. 2 is a front perspective view of a meditation chair without the seating pad according to the one embodiment of the present invention.
Figure 3:
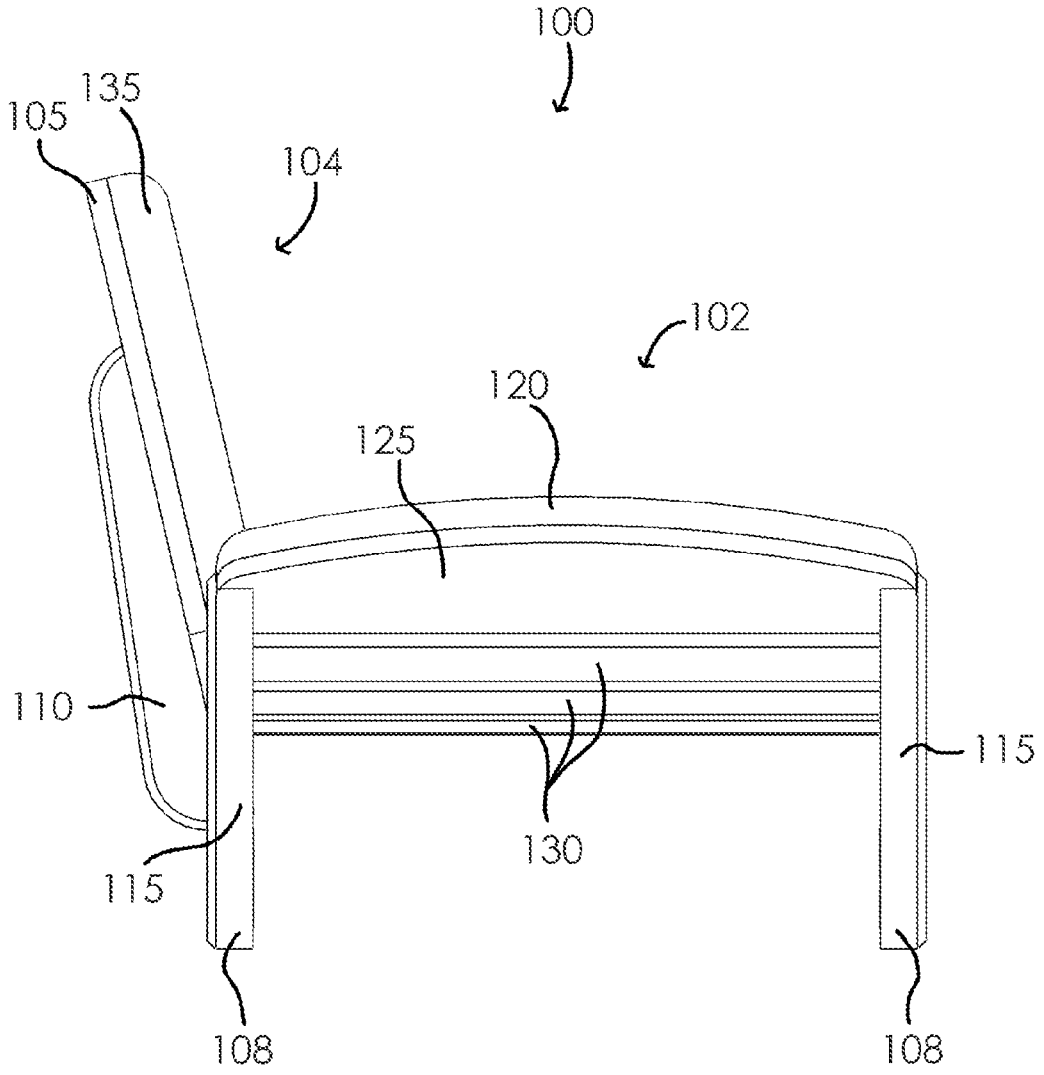
FIG. 3 is a right side view of the meditation chair according to the one embodiment of the present invention.
Figure 4:
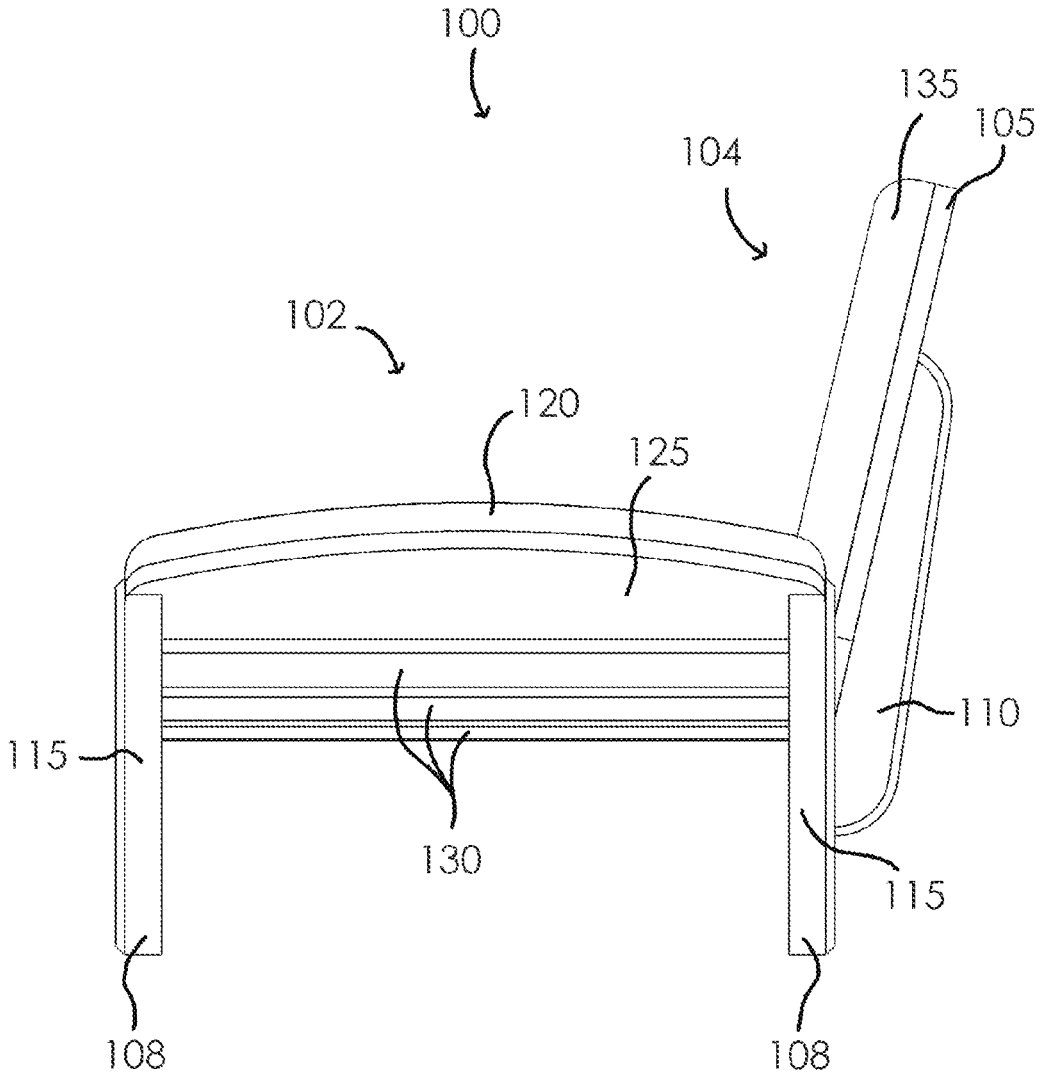
FIG. 4 is a left side view of the meditation chair according to the one embodiment of the present invention.
Figure 5:
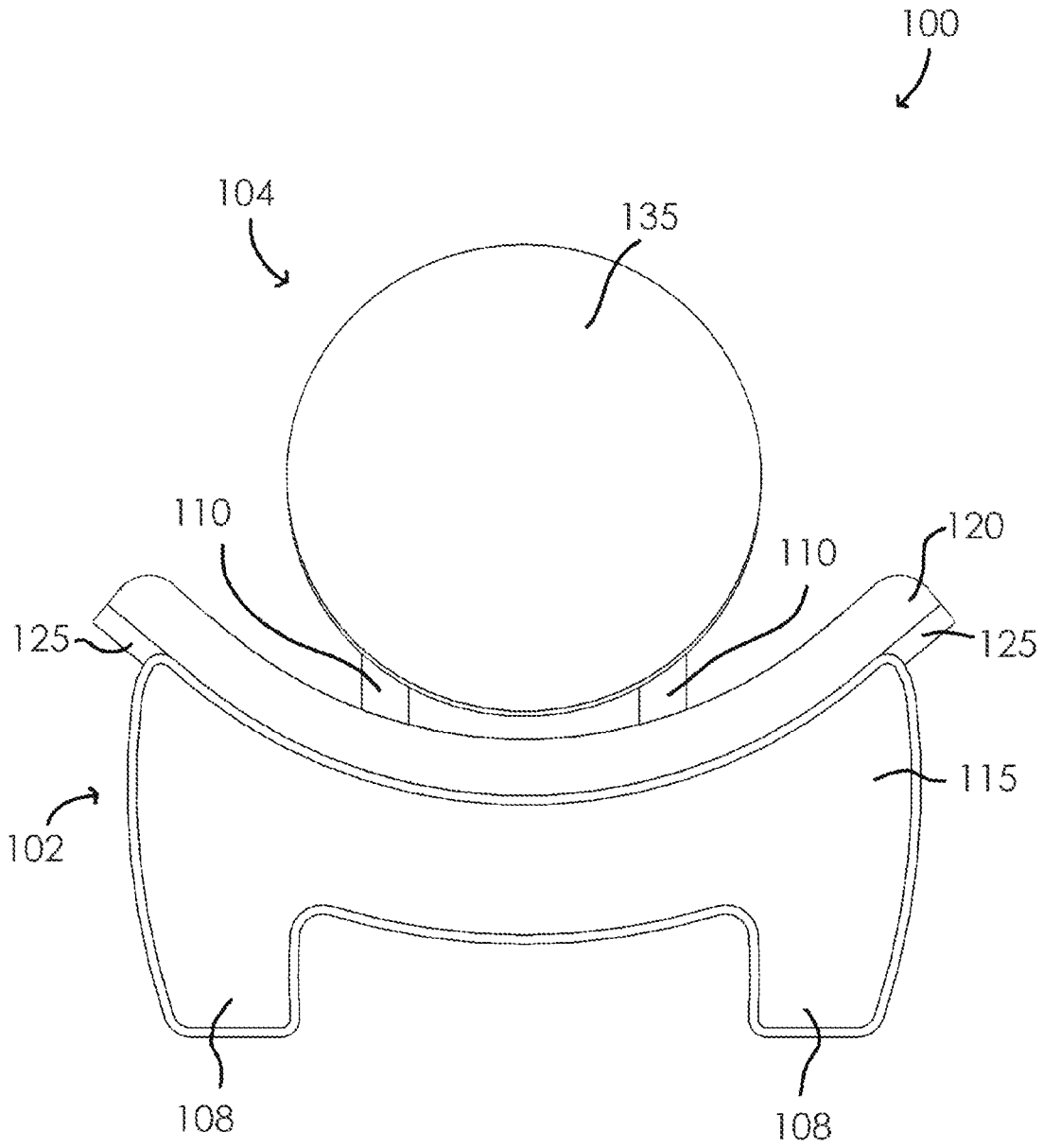
FIG. 5 is a front side view of the meditation chair according to the one embodiment of the present invention.
Figure 6:
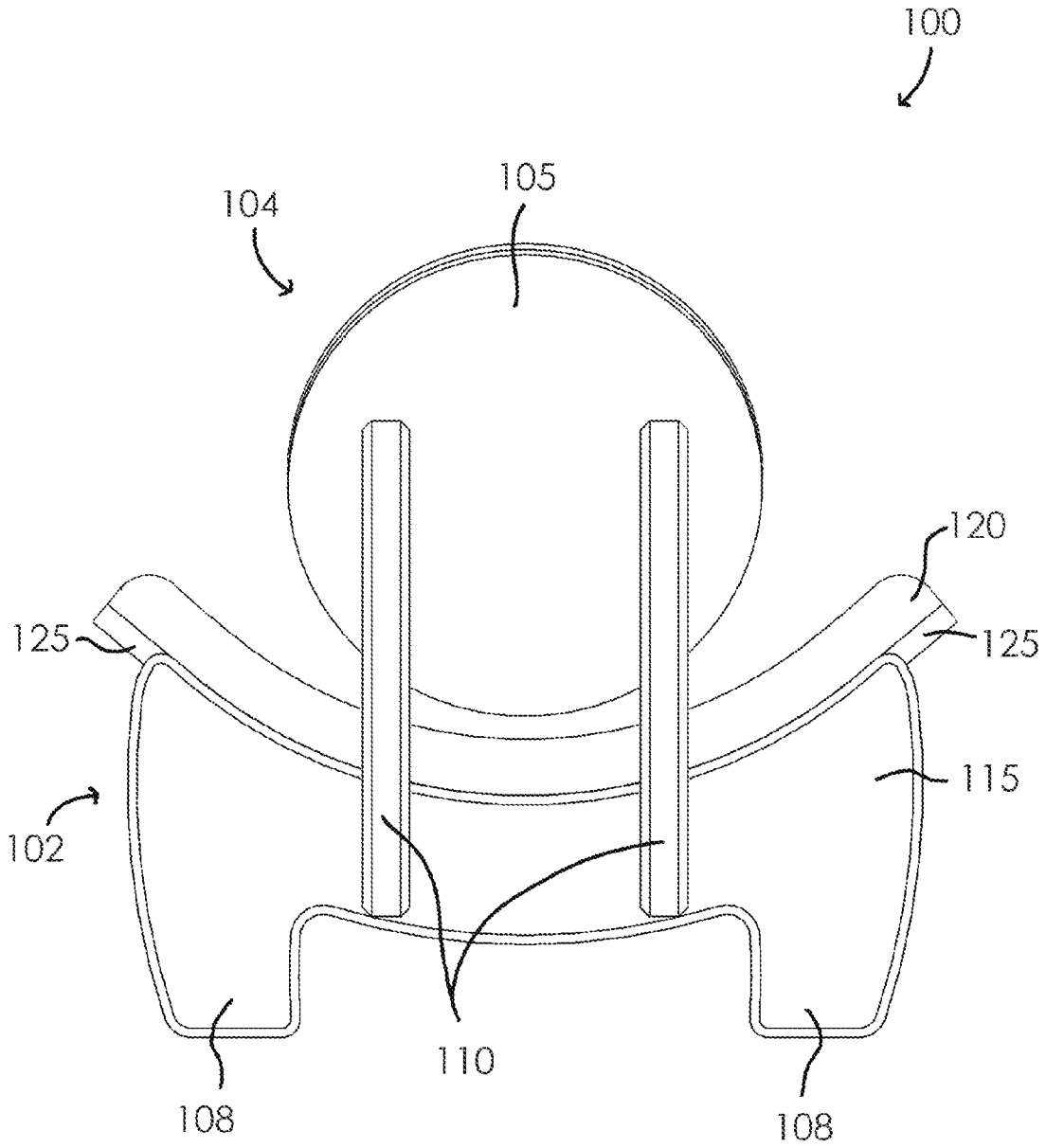
FIG. 6 is a back side view of the meditation chair according to the one embodiment of the present invention.
Figure 7:
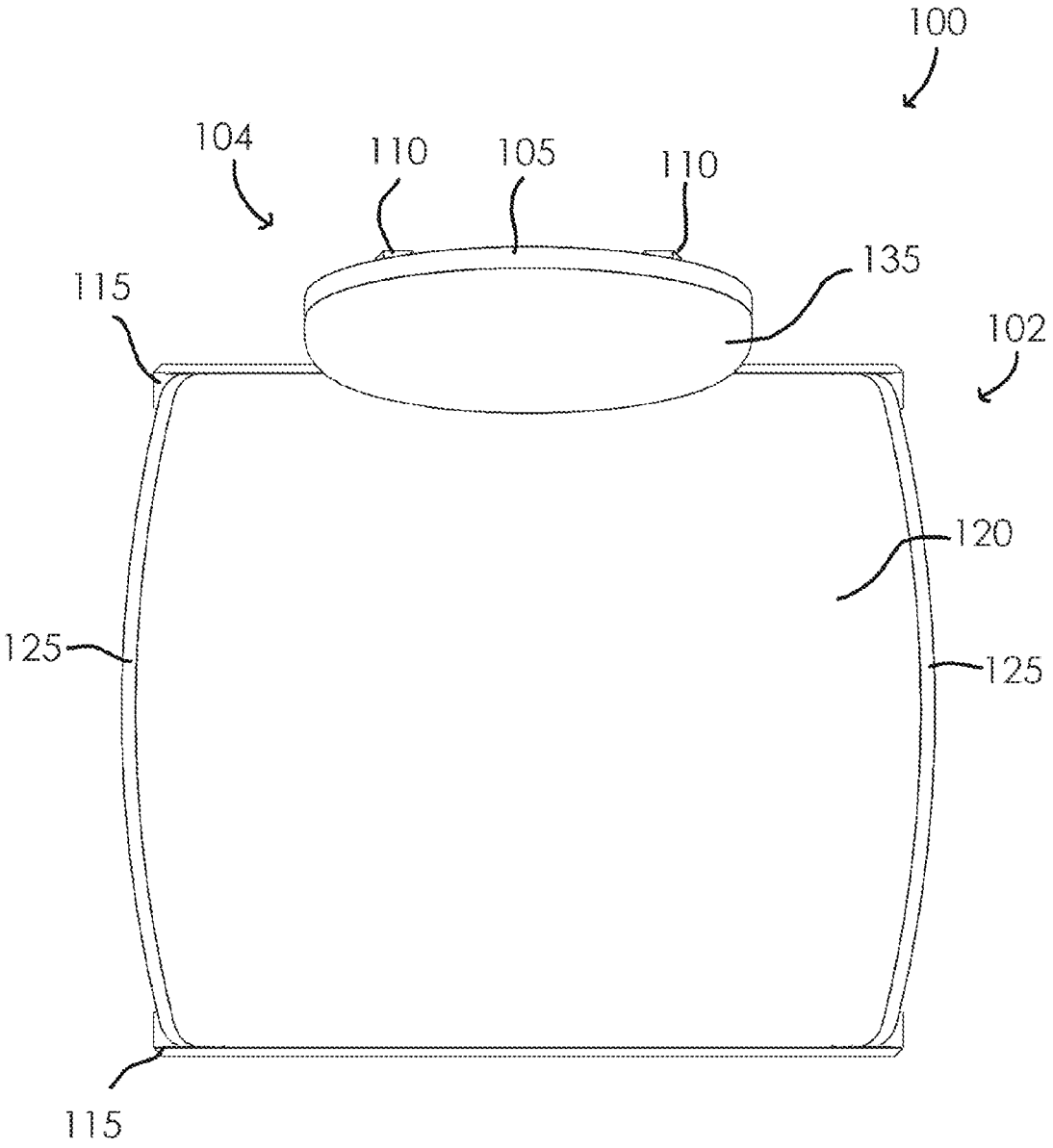
FIG. 7 is a top view of the meditation chair according to the one embodiment of the present invention.
Figure 8:
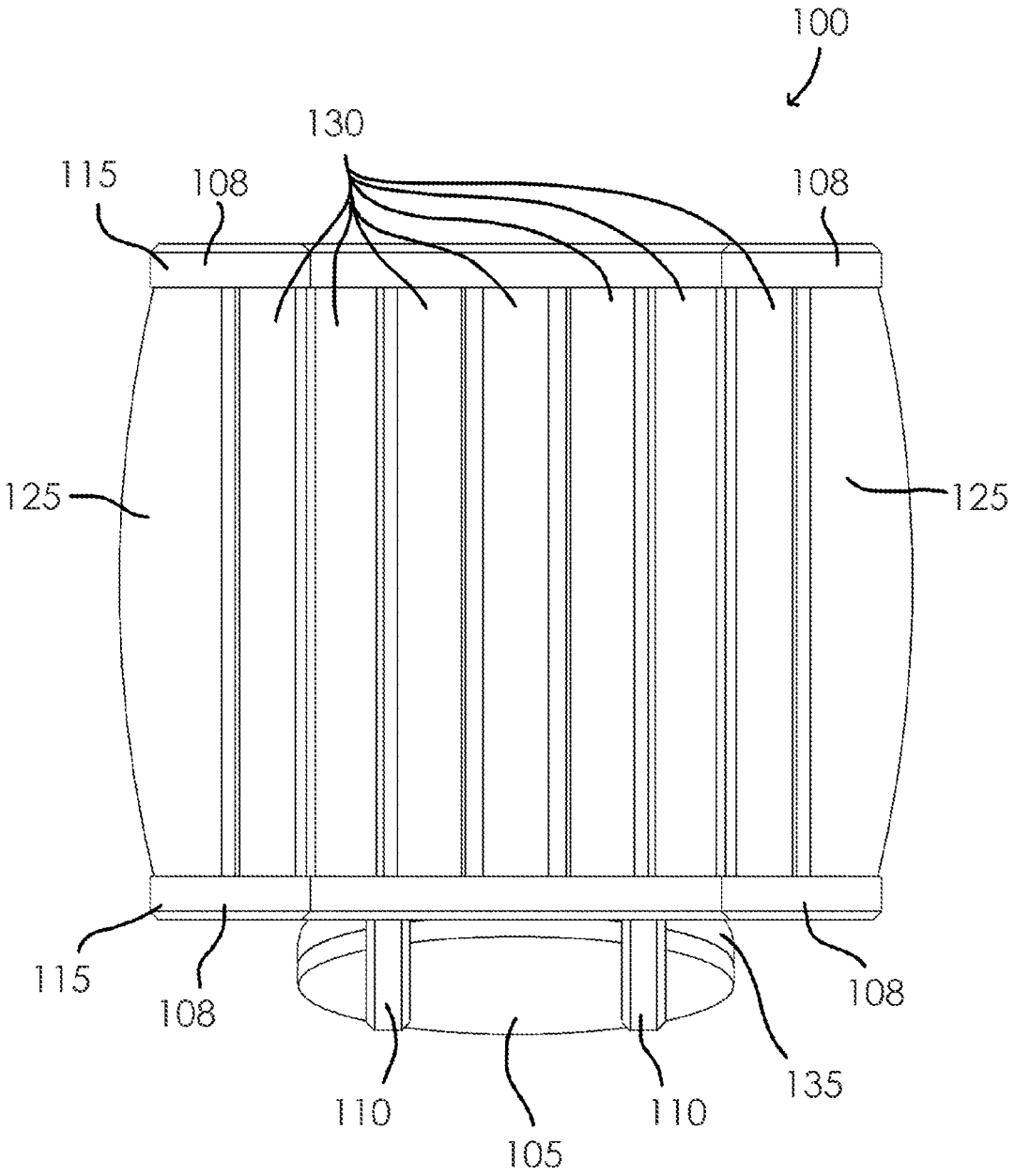
FIG. 8 is a bottom view of the meditation chair according to the one embodiment of the present invention.
Figure 9:
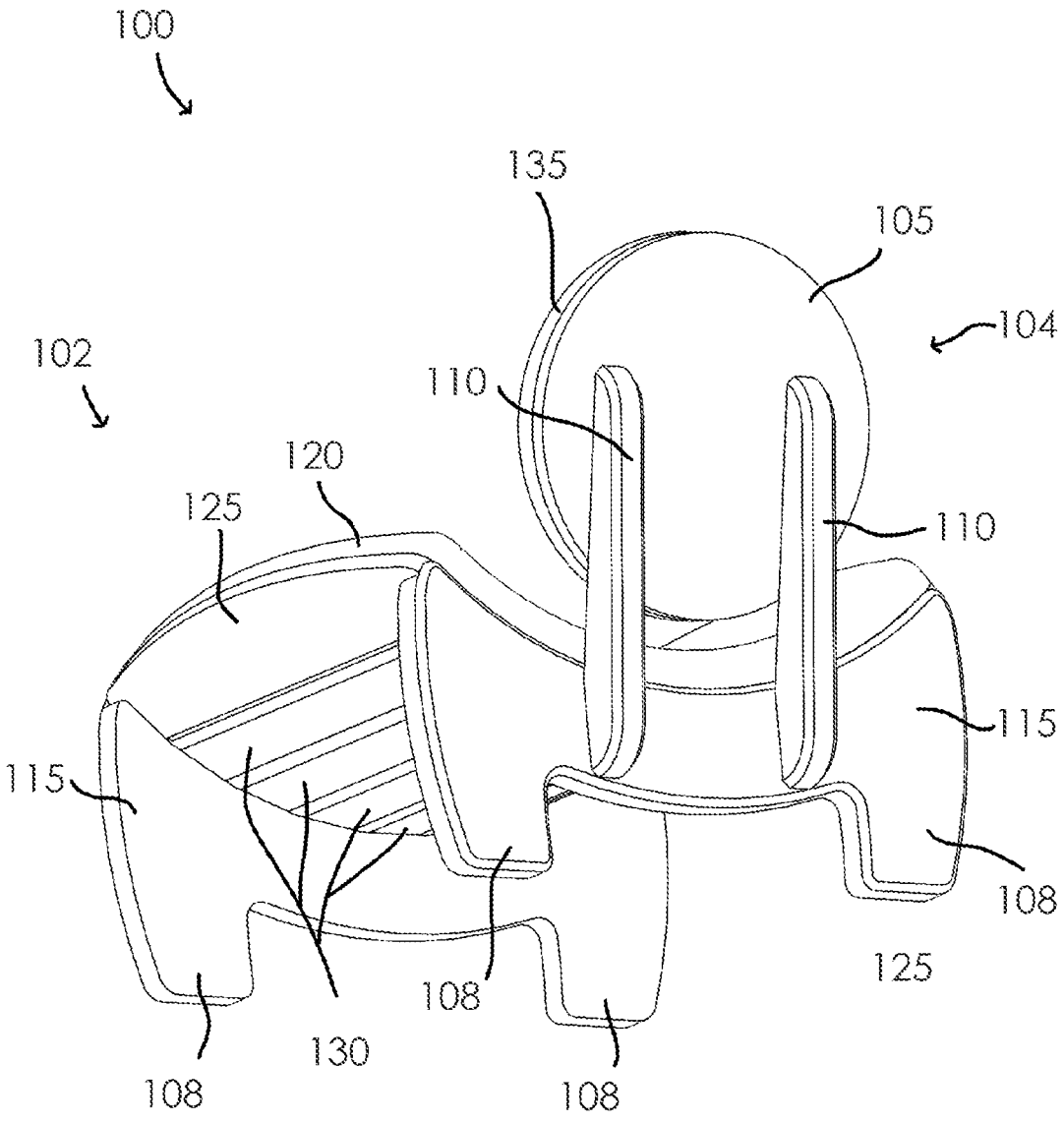
FIG. 9 is a back perspective view of the meditation chair according to the one embodiment of the present invention.

Embodiments of the present invention comprise a chair having a seatback and a raised seating surface. The raised seating surface has a front to back dimension (depth) substantially measuring in one variation approximately 0.8 meters. The seating surface further has a left to right side dimension (width) of approximately 0.8 to 0.9 meters depending on where the width is measured. The seating surface is further curved upwardly on the left and right sides relative to the front to back center of the seating surface. In one variation, the radius of curvature pertaining to the curve is about 0.5 meters. The ample width of the chair, as well as, its depth allows the totality of a user's buttock and legs to be supported on the seating surface while sitting cross legged. Further, the curvature of the surface provides support for the portions of the leg proximate and including the user's knees when in the same position. The seatback permits a user to more comfortably sit cross legged while leaning back slightly: something that cannot typically be done while sitting cross legged on the ground.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Mediation Chair

FIGS. 1-11 illustrate various views of an embodiment of the mediation chair 100. With reference to these figures generally and the exploded view of FIG. 10 specifically, the chair comprises: a seat base assembly 102 including front and back leg sections 115 having legs 108, and a plurality of seat support slats 125 & 130 forming a seat base secured to and spanning between the spaced leg sections, and a seat cushion 120; a seatback 104 including a pair of seatback arms 110 secured at a proximal end to the back leg section, a backrest 105 secured to the seatback arms, and a backrest cushion 135.

Figure 10:
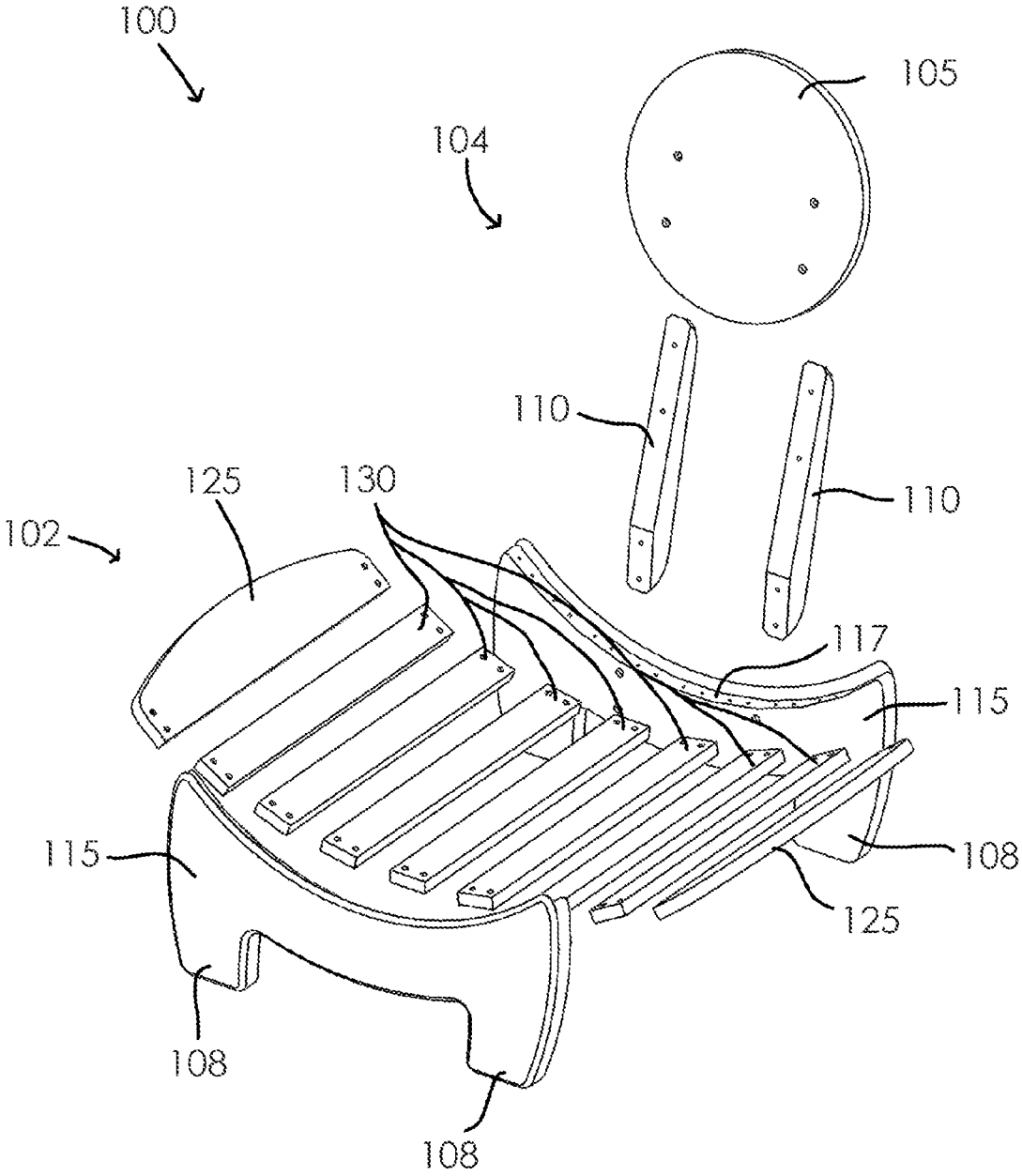
FIG. 10 is an exploded front perspective view of the meditation chair not showing seating and back pads according to the one embodiment of the present invention.

The front and back leg sections 115 are each generally planar and comprise a concavely curved top edge that effectively dictates the curvature of the seating surface 122. The seating surface being defined as the top surface of the seat cushion 120 or other surface on which the user directly sits. A recessed lip 117, as seen in FIG. 10, is provided recessed below the top edge approximately the thickness of the seat support slats 125 & 130, and the recessed lip curves in parallel with the top edge. The curvature of the seating surface preferably has radius of curvature of about 0.5 meters, and more preferably a radius of curvature of approximately 0.5 meters.

Along the bottom edge of each leg section 115 left and right legs 108 are formed by way of a cutout portion. The form and shape of the legs are largely a matter of design preference and in some variations the entire bottom edge may be configured for contact with floor or ground surface forming either a front leg or a rear leg. As can be appreciated, the height of the chair and the seating surface are largely dictated by the height of the leg sections. In the illustrated embodiment, the height of the front and back leg sections are the same, but variations are contemplated wherein the height of the back leg section is less than the front leg section causing the seating section to incline slightly towards the seatback assembly 104.

The planar leg sections 115 can be made of any suitable material and have thicknesses corresponding to the strength, stiffness, and other properties of the chosen material. For instance, the leg sections can be made of wood, composite laminate, plywood, reinforced or unreinforced plastic, and metal. In other embodiments and variations, the leg sections need not be planar or unitary pieces.

As indicated above the leg sections 115 are spaced apart and attached to each other by way of the seat slats 125 & 130 that together form part of a seat base. The chair comprises left and right end slats 125 that are wider than middle slats 130 and include a finished curved edge that extends beyond the corresponding left or right edge of the leg sections 115. As indicated by their name the left and right end slats are secured to the leg sections in the recessed lips 117 proximate the respective left or right edges thereof. The middle slats are rectangular in shape. The middle slats are evenly spaced along and secured to the recessed lips 117 between the end slats. Generally, the slats are fastened to the leg sections by way of threaded fasteners or nails. Alternatively or additionally, the slats can be adhesively bonded in place. Depending on the construction of the leg sections and the slats, other joining technologies can be utilized as well.

As with the leg sections 115, the slats 125 & 130 can be made of any suitable material including any one or combination of the materials provided above for the leg sections 115.

The seatback arms 110 are secured to the back leg section 115 at a proximal end thereof typically using threaded fasteners, although any suitable means of attachment including adhesive bonding, nailing, and welding can be utilized, The pair of seatback arms extended upwardly in parallel and can be canted rearwardly a few degrees (typically 0-15 degrees) off of orthogonal with the seating surface 122. A backrest 105 is attached to the arms generally proximate the distal ends of the arms by any suitable means, such as threaded fasteners.

As with the leg sections, the seatback arms 110 and the backrest 105 can be made of any suitable material including any one or combination of the materials provided above for the leg sections 115. Further, the configuration of the seatback 104 can vary significantly and substantially in other embodiments and variations. In one embodiment, the seatback or a portion of it, such as the seatback arms, can be integrated into the base assembly. For instance, the seatback arm can comprise a portion of the back leg section extending upwardly to form the seatback arm. In yet another variation, the backrest can be further integral with the seatback arm. The backrest can be other shapes than that of the round backrest illustrated. The backrest need not be planar but can have a curved contour. A single seatback arm can also replace the pair in variations.

The seat cushion 120 is received over the slats 125 & 130. It can be of any suitable construction but typically comprises a open or closed cell foam that is covered in a flexible material, such as but not limited to fabric, vinyl, simulated leather and leather. The seat cushion can be substantially flat or planar wherein it takes on the curve of the underlying base assembly 102 when installed thereon, or the cushion can be fabricated with a curve that is complimentary with the corresponding curve of the base assembly. The cushion can be either fixedly or removably secured to the underlying slats. In yet another variation, the cushion may simply rest on the slats. For instance in some variations, the seat cushion can be secured to the slats at select locations using hook and loop material strips.

The backrest cushion 135 is received on and substantially covers a front face of the backrest 105. Like the seat cushion, it typically comprises an open or closed cell foam that is covered in a flexible material, such as but not limited to fabric, vinyl, simulated leather and leather. The backrest cushion can be secured to the backrest by any suitable means including hook and loop strips, adhesive and mechanical fastening. Some variations of the chair may not include a backrest cushion.

Figure 11:
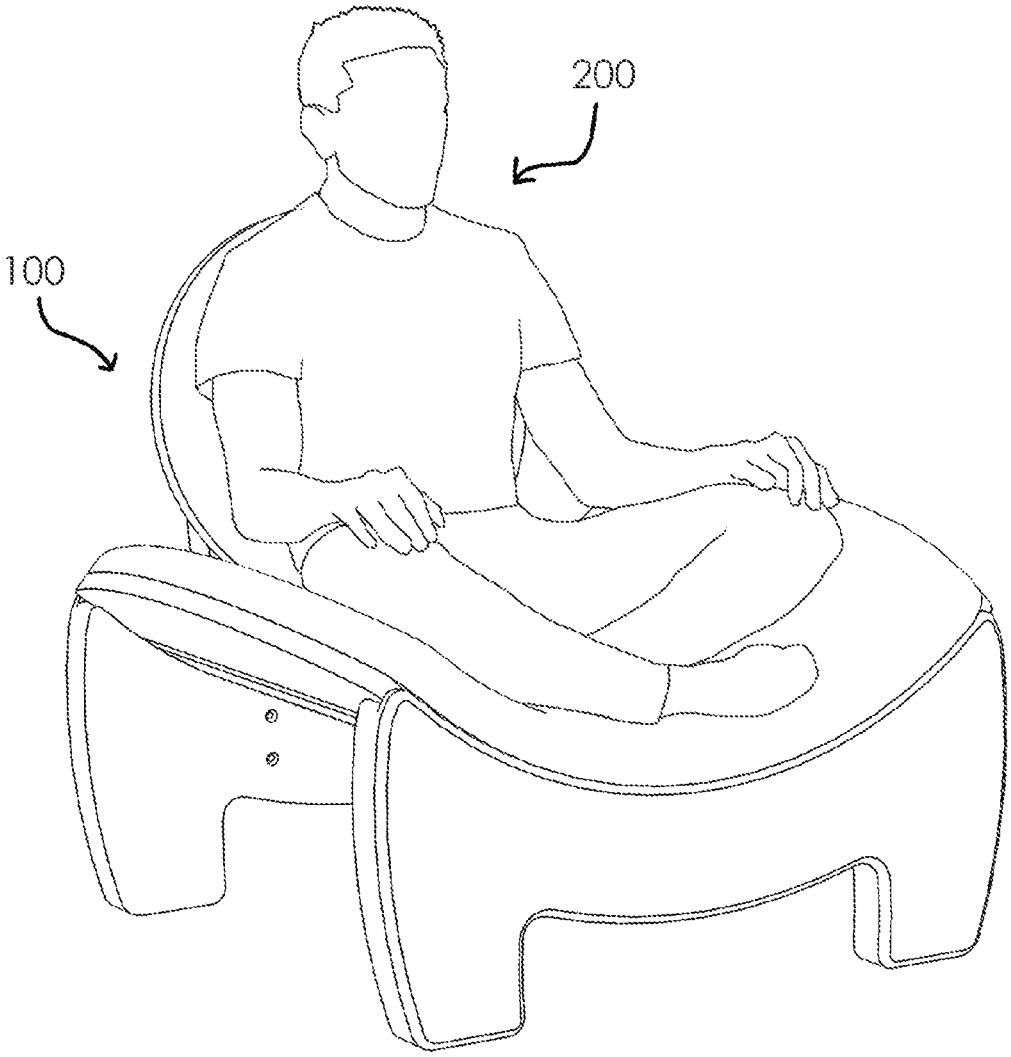
FIG. 11 is a front perspective view of the meditation chair with a user sitting thereon according to the one embodiment of the present invention.

The overall dimensions of the chair and more particularly the dimensions associated with the seating surface 122 can vary from embodiment to embodiment and variation to variation; however, at least one embodiment exhibits the dimensions and combination of dimensions described herein. The depth of the seating surface 122 from the front edge to the back edge thereof is sufficient to permit an adult 200 to assume a crossed leg stance while sitting on the chair 100 wherein his/her legs are fully supported by the seat cushion on the seating surface as best illustrated in FIG. 11. Ideally, the depth is approximately 0.8 meters. As can be appreciated, prior art chairs usually do not have depths greater than 0.55 meters as this would put the knees over the seating surface and prevent a user from dangling the lower part of his/her legs downwardly towards the floor.

The left to right horizontal width of the seating surface 122 is also wider than most prior art chairs to accommodate a person sitting cross legged. At its shortest, the left to right horizontal width is approximately 0.8 meters, and at the center of the end slats which curve outwardly towards their middle, the width is a little longer at approximately 0.9 meters.

The actual length of the arc extending between the left and right edges is longer. The radius of the arc extending left to right on the seating surface 122 is similar to the radius of the arc of the top edge of the leg sections 115 increased by the thickness of the seating cushion. The extent of the arc from right to left is approximately 90-120 degrees, more preferably approximately 100-110 degrees and most preferably approximately 105 degrees. The arc causes the left and right portions of the seating surface to be raised up relative to the center thereof providing support for the portions of a user's legs proximate and including his/her knees that when in a crossed leg seating position tend to naturally want to be disposed above the user's buttock. This can increase the comfort of sitting in a chair cross legged when compared to a flat seating surface. As described herein, the arc of the seating surface as well as the curvature of the seating surface are described in terms of an arc and radius of a circle. It is to be appreciated that the curve need not completely approximate a portion of a circle, but can comprise, for instance, a portion of an oval.

A Method of Using an Embodiment of the Mediation Chair

FIG. 11 illustrates a person 200 seated on the chair 100 with his legs crossed. As can be seen the raised left and right portions of the seating surface 122 support the user's knees and portions of the legs proximate the knees. The user can further rest his/her back against the backrest 105 providing back support. Back support is not typically provided when sitting cross legged on a floor unless a person is sitting proximate a wall or other vertical surface.

To use the chair, a user typically sits his bottom in the chair in a typical fashion with his legs dangling from the front edge of the seating surface. Next, the user scoots himself rearwardly in the chair until his back is proximate the seatback and his knees are located substantially behind the front edge of the seating surface. The user then folds his legs into the crossed configuration as seen in FIG. 11. He can also lean back and rest his back against the backrest.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. Some variations include but are not limited to the following: (1) the backrest can be any suitable shape and need not be round; (2) a single seatback arm can be used to support the backrest; (3) the seatback can be provided without a seatback cushion; (4) the seatback can be partially or wholly integral with the base assembly; (5) the dimensions of the seating surface can vary while remaining within suitable ratios and limits to provide the desired benefits; (6) a seating surface can be provided that does not comprise a cushion but maybe a hard surface; (7) a single piece of shaped wood can replace the plurality of slats connecting the front and back leg sections; and (8) the shape and configuration of the leg section can vary such that in one variation the left and right leg sections are provided instead of front and back leg sections. All variations of the invention that read upon appended claims are intended and contemplated to be within the scope of the invention.

I claim:

1. A chair comprising:

a base assembly including a plurality of chair legs, the base assembly defining a seating surface, the seating surface (i) having a minimum right to left width of approximately 0.8 meters and a front to back depth of approximately 0.8 meters, (ii) being curved along its width at a radius of about 0.5 meters: and a seatback, the seatback being coupled with the base assembly;

wherein the base assembly further comprises (a) a front leg section and a back leg section, each leg section including at least one leg of the plurality of chair legs and a concavely curved top edge, and (b) a plurality of spaced slats, each slat being secured to the front leg section proximate the concavely curved top of the front leg section at a first end and to the back leg section proximate the concavely curved top of the back leg section at a second end.

2. The seatback of claim 1 comprising a backrest and at least one seatback arm coupling the seatback to the base assembly.

3. The chair of claim 2, wherein the seatback further includes a backrest cushion, the backrest cushion being secured to the backrest.

4. The seatback of claim 1, wherein the seatback is at least partially integral with the base assembly.

5. The chair of claim 1, wherein each leg section further includes a curved recessed lip proximate the concavely curved top edge, ends of the curved slats being received against the curved recessed lips.

6. The chair of claim 1, wherein the base assembly further includes a seat cushion with a top surface, the top surface defining the seating surface.

7. The chair of claim 1, wherein the base assembly further includes a seat cushion with a top surface, the top surface defining the seating surface, the seat cushion being supported by the plurality of spaced slats.

8. The chair of claim 1, wherein the front and back leg sections comprise one or more of wood, metal, plastic, and composite materials.

9. The chair of claim 8, wherein the plurality of slats comprise one or more of wood, metal, plastic, and composite materials.

10. The chair of claim 1, wherein each leg section comprises left and right legs.

11. The chair of claim 1, wherein a front surface of the backrest is canted rearwardly relative of the seating surface at an angle of 95-120 degrees.

12. A method of using the chair of claim 1, the method comprising:

placing a buttock onto the seating surface;

sliding rearwardly on the seating surface until knees of the user are positioned fully on the seating surface;

crossing legs of the user; and resting the knees against the seating surface.

13. The method of claim 12, further comprising resting the back of the user against the seatback while the legs are crossed.

14. A chair comprising:

a base assembly, the base assembly including (a) a front leg section and a back leg section, each leg section including at least one leg of the plurality of chair legs and a concavely curved top edge, (b) a plurality of spaced slats, each slat being secured to the front leg section proximate the concavely curved top of the front leg section at a first end and to the back leg section proximate the concavely curved top of the back leg section at a second end, and (c) a seat cushion with a top surface, the top surface defining a seating surface, the seat cushion being supported by the plurality of spaced slats; and a seatback assembly, the seatback assembly including, a backrest, and at least one seatback arm connecting the seatback to the base assembly;

wherein the seating surface has a minimum right to left width of approximately 0.8 meters and a front to back depth of approximately 0.8 meters, and is curved along its width at a radius of approximately 0.5 meters.

15. The chair of claim 14, wherein a front surface of the backrest is canted rearwardly relative of the seating surface at an angle of 95-120 degrees.

16. The chair of claim 14, wherein the seatback assembly further includes a backrest cushion, the backrest cushion being secured to the backrest.

17. A method of using the chair of claim 14, the method comprising:

placing a buttock onto the seating surface;

sliding rearwardly on the seating surface until knees of the user are positioned fully on the seating surface;

crossing legs of the user; and resting the knees against the seating surface.

18. The method of claim 17, further comprising resting the back of the user against the backrest while the legs are crossed.

* * * * *